US007614608B1

(12) United States Patent
Ebbenga

(10) Patent No.: US 7,614,608 B1
(45) Date of Patent: Nov. 10, 2009

(54) ROPE TENSIONER FOR WINCH

(76) Inventor: Mark Ebbenga, 8410 Itasca Ct., Forest Lake, MN (US) 55025

( * ) Notice: Subject to any disclaimer, the term of this patent is extended or adjusted under 35 U.S.C. 154(b) by 58 days.

(21) Appl. No.: 12/120,552

(22) Filed: May 14, 2008

(51) Int. Cl.
*B66D 1/26* (2006.01)

(52) U.S. Cl. ..... 254/278; 254/279; 254/281; 254/285

(58) Field of Classification Search ..... 254/278, 254/279, 280, 281, 285
See application file for complete search history.

*Primary Examiner*—Emmanuel M Marcelo
(74) *Attorney, Agent, or Firm*—Westman, Champlin & Kelly, PA; Z. Peter Sawicki

(57) ABSTRACT

An apparatus is disclosed for tensioning lines of a winch having a reel and three lines wound about the reel. The apparatus is used to position an object on a support. The first and second lines are wound about the reel in a first direction and the third line is wound about the reel in a second direction opposite the first direction. The first line extends around the first guide, the second line extends around the second guide, and the third line extends between the first and second guides. All three lines are connected to each other and to the object at their distal ends. An inner frame and an outer frame each contact the first and second lines. The inner frame and the outer frame are movable with respect to each other to maintain tension in the first and second lines.

12 Claims, 8 Drawing Sheets

ROPE TENSIONER FOR WINCH

BACKGROUND OF THE INVENTION

The present invention relates to an apparatus used for maintaining tension in lines when moving a boat or other object onto a trailer, truck bed, or other support surface.

Boating, whether with family and friends or by yourself, can be an enjoyable experience. However, at the end of the day, the pilot must maneuver the boat onto the boat trailer, which can be a difficult task.

Especially when boating by oneself, securing the boat onto the trailer can be difficult. The pilot of the boat typically must first secure the boat to a dock, a pier or a pylon and exit the boat and position the trailer into the body of water so that the boat can be guided onto the trailer. After positioning the trailer into the body of water, the pilot then must get back into the boat, unsecure the boat from the dock, the pier or the pylon and proceed to align the boat with the trailer.

After positioning the boat proximate the trailer, the pilot typically must maintain control of the boat while having to exit the boat and enter the body of water to secure a clip attached to a line wound on a winch to an eyelet typically welded to the bow of the boat. This task can be difficult for a number of reasons including extremely cold water causing discomfort to the pilot, wind causing the boat to drift out of alignment with the trailer and even forcing the boat away from the trailer, and waves causing the boat to drift while not secured to the trailer.

Once the pilot of the boat has secured the clip to the eyelet on the bow of the boat, the pilot must then manually operate the winch to draw the boat further onto the trailer while maintaining alignment of the boat. Maintaining alignment of the boat during the process of securing the boat to the trailer may be difficult due to the external forces on the boat such as wind and waves. Not being able to align the boat on the trailer may cause the boat owner significant frustration and delay in attempting to secure the boat to the trailer, and ultimately towing the trailer and the boat from the body of water.

SUMMARY OF THE INVENTION

An apparatus is disclosed for positioning an object on a support surface having a first guide and a second guide mounted thereon. The apparatus includes a winch having a reel and three lines wound about the reel. The first and second lines are wound about the reel in a first direction and the third line is wound about the reel in a second direction opposite the first direction. The first line extends around the first guide, the second line extends around the second guide, and the third line extends between the first and second guides. All three lines are connected to each other and to the object at their distal ends. An inner frame and an outer frame each contact the first and second lines. The inner frame and the outer frame are movable with respect to each other to maintain tension in the first and second lines.

DETAILED DESCRIPTION OF THE PREFERRED EMBODIMENTS

Figure 1:
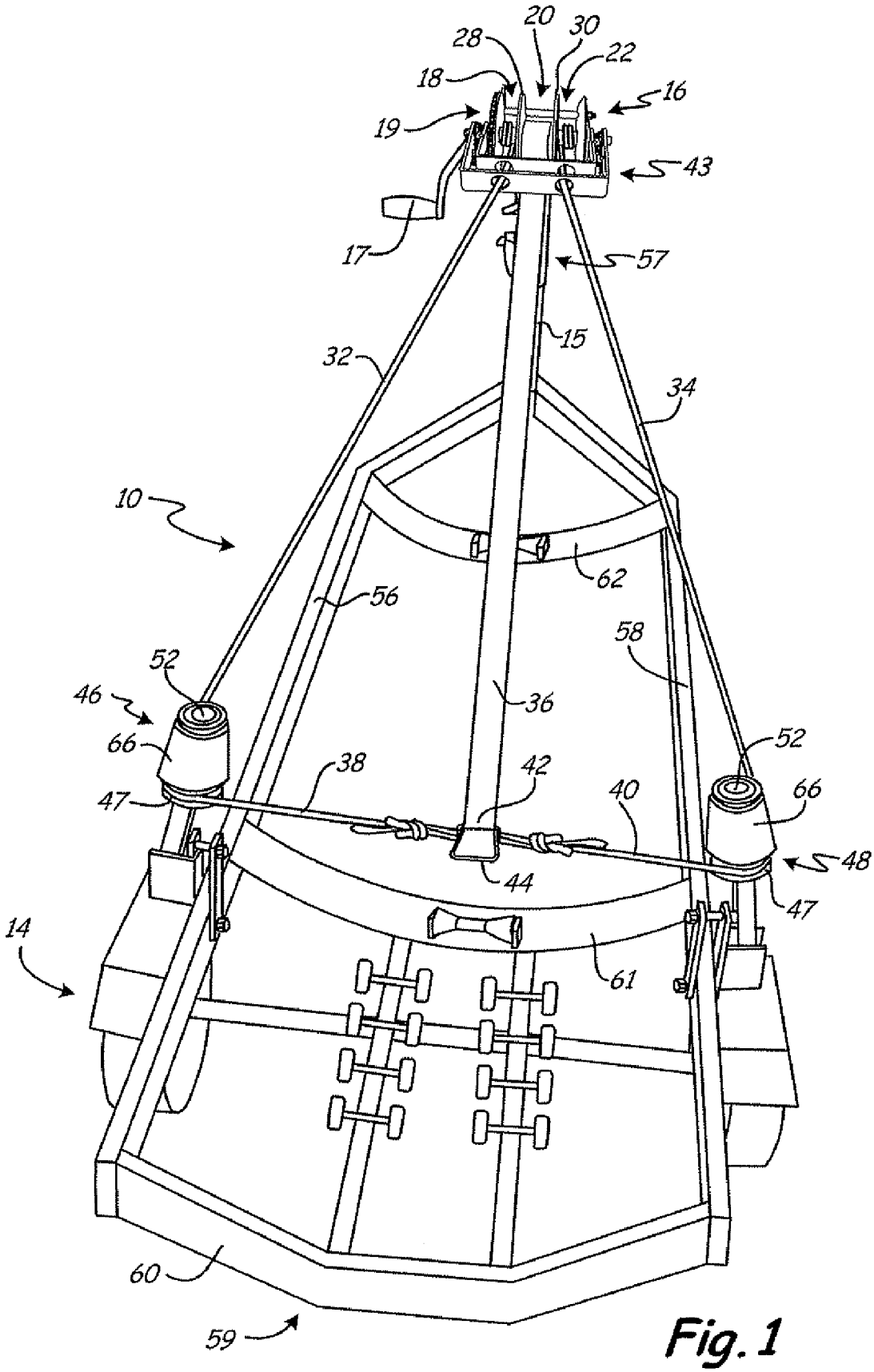
FIG. 1 is a perspective view of a boat trailer having a winch system with a rope tensioner of the present invention attached thereto in an engaging position.

A winch system with a rope tensioner of the present invention mounted to a boat trailer is generally illustrated in FIG. 1 at 10. The winch system 10 allows one person to secure a boat 12 (shown in FIG. 3) to a trailer 14 without having to exit the boat 12 during the process of positioning the boat 12 on the trailer 14. This application incorporates by reference in its entirety U.S. Pat. No. 7,179,041 to Ebbenga entitled "Multi-compartmental winch device."

Referring to FIG. 1, the winch system 10 includes a winch 16 having a reel 19 with at least three partitioned compartments, a left compartment 18, a middle compartment 20 and a right compartment 22 separated by left and right partitions 28 and 30. The winch 16 is mounted to a tongue 15 located at a proximal end 57 of the trailer 14.

Proximal ends of a left line 32 and a right line 34 are coiled about the left compartment 18 and the right compartment 22, respectively, of the winch 16 in a first rotational direction. A middle line 36 is coiled about the middle compartment 20 in a second rotational direction, opposite the first rotational direction. By line is meant either a cable, cord, wire or strap made of natural or synthetic (such as plastic) materials or metal or combination thereof including but not limited to a single filament, strand or strap, braided or woven filaments, strands, or fibers, fibrillated or twisted line, or simply twisted fibers. All that is required of the line is the appropriate tensile strength for the task such as pulling the boat onto the trailer and sufficient limpness of the line to be coiled onto the reel of the winch.

Distal ends 38, 40, and 42 of the left line 32, the right line 34 and the middle line 36, all respectively, are connected to each other such that each of the lines is under tension and not slack. Rope tensioner 43 will be described in detail with reference to FIGS. 4 and 5. The distal end of the middle line 36 includes a loop 44 onto which smaller loops of the distal ends 38, 40 of the left and right lines 32, 34, respectively, are connected. Alternatively, the distal ends of the left and right lines may be fixedly secured to the distal end of the middle line 122. Moreover, the configuration may include a segment connecting the left and right lines. The segment may be constructed of a flexible or a rigid material such as metal or plastic.

Referring to FIG. 1, the left and right lines 32, 34 are guided by left and right guides 46, 48, that are mounted to left and right side members 56, 58 of the trailer 14, respectively. The left and right side members 56, 58 are separated by cross members 60, 61 and 62 to provide strength and stability to the trailer 14. The left and right guides 46, 48 are mirror images of each other and therefore only the right guide 48 will be described in detail.

Figure 2:
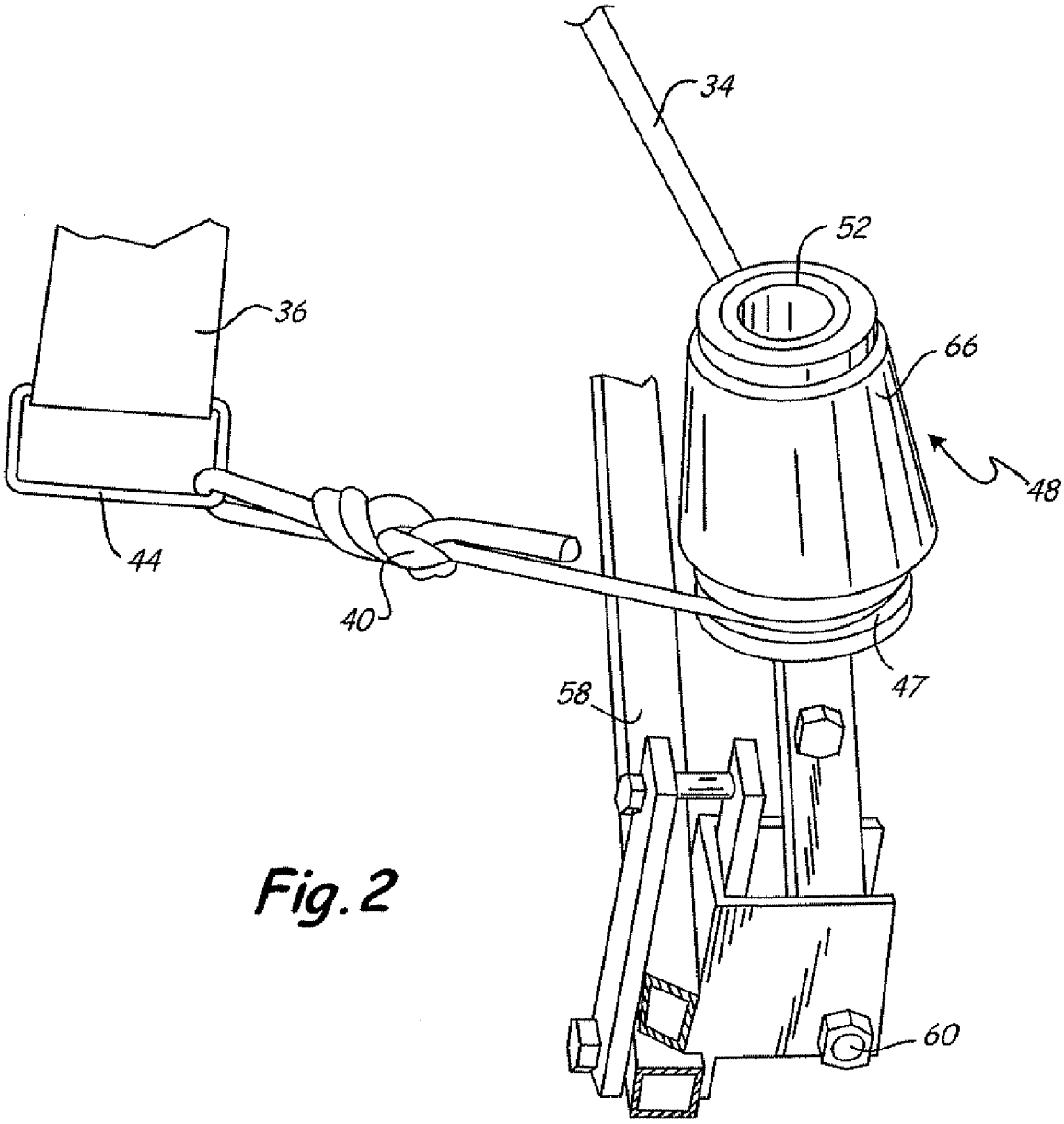
FIG. 2 is a partial perspective view of a guide.

Referring to FIG. 2, the guide 48 preferably includes a freely rotatable pulley 47 mounted to an axle 52. The axle 52 is pivotally mounted to the right side member 58 of the trailer 14 with a pivot bolt 60 that allows the pulley 47 to pivot towards and away from the right side member 58. The right guide 48 also preferably includes a bumper 66 that helps in guiding the boat 12 onto the trailer 14 without damaging a hull of the boat 12. Preferably, the bumpers 66 are constructed from a rubber or soft polymeric material which has compressive characteristics. The left guide 46 includes like components having the same reference characters as the components of the right guide 48

Figure 3:
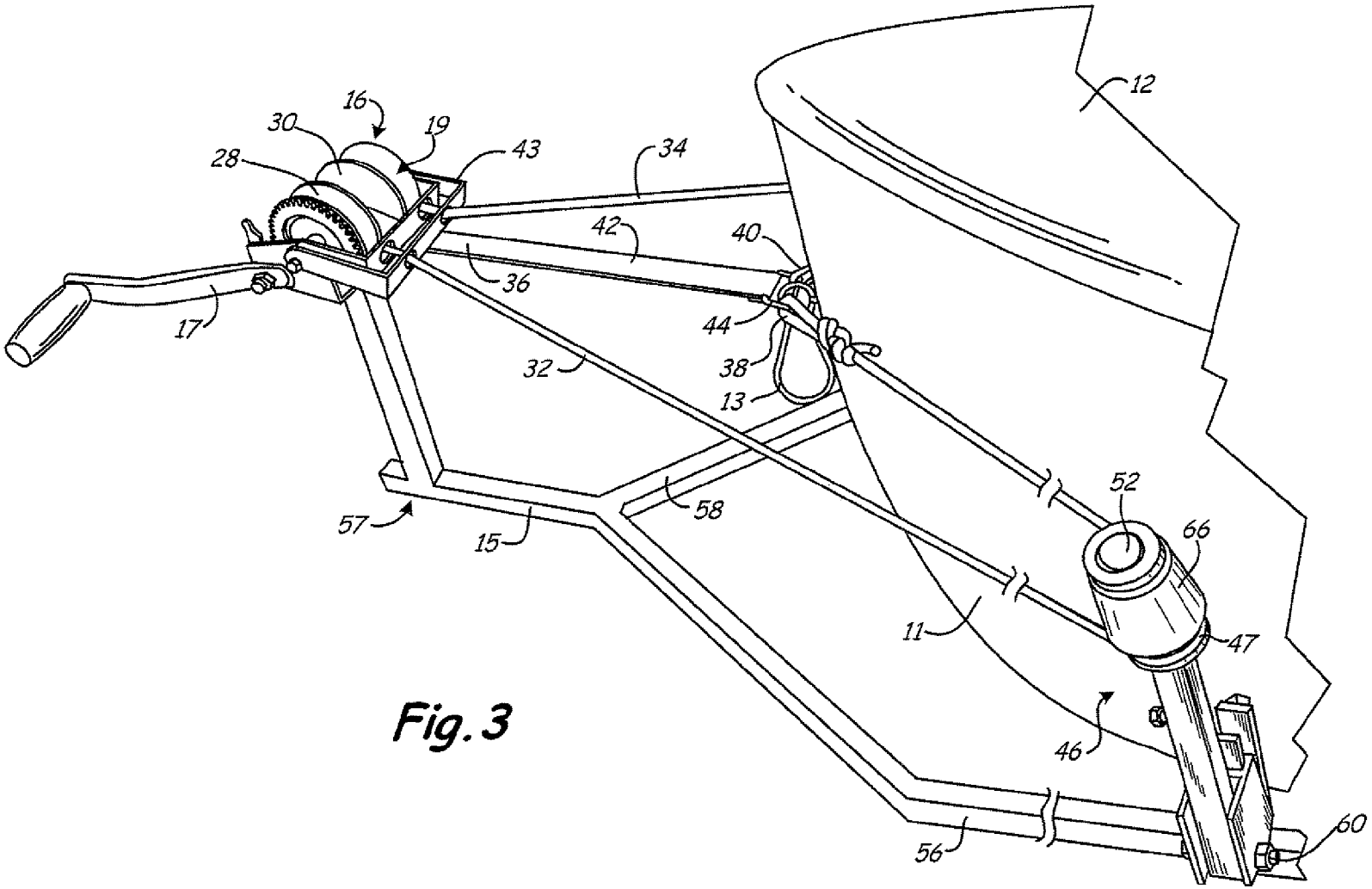
FIG. 3 is a partial perspective view of a winch system having a boat secured thereto and positioned proximate the winch.

The winch system 10 is positionable in a first position as illustrated in FIG. 1, wherein the left and right lines 32, 34 and the loop 44 are taut between the left and right guides 46, 48. Referring to FIG. 3, a spring biased clip 13 is fixedly attached to a bow 11 of the boat 12. As the boat 12 is piloted over a rearward end 59 of the trailer 14, the clip 13 engages the loop 44 between the left and right lines 32, 34. With the clip 13 secured to the loop 44, the boat 12 is secured for reeling onto the trailer 14. The winch 16 preferably is in an unlocked position such that the force of the boat 12 allows the winch 16 to rotate as the boat 12 is propelled towards the winch 16. As the winch 16 rotates, the length of the middle line 36 decreases while the lengths of the left and right lines 32, 34 increase.

With the bow 11 of the boat 12 proximate the winch 16, the pilot of the boat 12 can walk to the bow 11 and grab a handle 17 of the winch 16 and rotate the reel 19 such that the boat 12 is brought to a fully forward position on the trailer 14 for further securance. Besides a manual winch 16, the present invention also includes a winch powered by an electric motor or a winch operated by a pneumatic motor either controlled at the winch itself or remotely controlled from a distance away from the winch.

Referring to FIG. 3, the winch system 10 is positioned in a second position where the length of the middle line 36 has been minimized while the lengths of the left and right lines 32 and 34 are maximized by the reverse winding of the middle line 36 as compared to the left and right lines 32 and 34 on the compartmentalized reel 19. One skilled in the art will recognize that the operator of the winch 16 can control the distance that the boat is on the trailer between the guides 46, 48 and the winch 16 and any position there between by the winch system 10 of the present invention. The bow 11 of the boat 12 can be maintained in an intermediate position between the second securing position and the first engaging position illustrated in FIG. 1 by rotating the winch 16 such that the distal end 42 of the middle line 36 is a selected distance between the winch 16 and the guides 46, 48. One skilled in the art will recognize the maximum distance that the boat 12 can be moved by the winch system 10 of the present invention is a distance between the guides 46, 48 and the winch 16.

Tension on left and right lines 32, 34 is maintained with the use of rope tensioner 43. Tension on line 36 is maintained by the weight of boat 12. Because there is tension on all three lines 32, 34 and 36, the boat 12 will be retained in the selected position by the tautness of the middle line 36 pulling the boat 12 toward the winch 16 and the tautness of the left and right lines 32, 34 pulling the boat 12 away from the winch 16 and towards the guides 46, 48. The three line design centers and pulls boat 12 forward while loading boat 12 onto trailer 14 and casts boat 12 off trailer 14 when unloading.

In operation, the boat 12 is preferably on a body of water having a landing site (not shown) and a dock or pier (not shown) positioned nearby. The pilot preferably secures the boat 12 to the dock or pier (not shown) and transports himself/herself to the trailer 14, which is preferably attached to a vehicle (not shown). The pilot backs the trailer 14 into the body of water at the landing site such that the loop 44 as illustrated in FIG. 2 will engage the clip 13 attached to the bow 11 of the boat 12. With the lines 32, 34, 36 and the loop 44 in a taut arrangement, the winch 16 is unlocked such that the winch 16 will freely rotate when force is applied to the lines 32, 34, 36 and the loop 44. With the trailer 14 secured in a selected position in the body of water, the pilot transports himself/herself back to the dock or pier and detaches the boat 12 from the dock or pier such that boat 12 can be maneuvered through the water onto the trailer 14.

The pilot aligns the boat 12 with the loop 44 that connects the lines 32, 34, 36, and by driving the boat over the trailer forces the spring biased clip 13 into the loop 44 such that the clip 13 engages loop 44, thereby attaching the boat 12 to the winch 16. The pilot propels the boat 12 onto the trailer 14, causing the winch 16 to rotate wherein the left and right lines 32, 34 uncoil from the reel 19, and the middle line 36 coils about the reel 19. Preferably, the bow 11 of the boat 12 is forced sufficiently near the winch 16 such that the pilot can walk to the bow 11 of the boat 12, grip the handle 17 on the winch 16, and turn the reel 19 to move the boat to its most forward position for securing the boat 12 to the trailer 14. The pilot then climbs out of the boat 12 and onto the trailer 14 and walks on the trailer 14 onto the shore, having secured the boat 12 to the trailer 14 without ever getting wet. The pilot then drives the vehicle (not shown) away from the landing site with the boat 12 properly aligned on the trailer 14 in tow.

The winch system 10 of the present invention has significant advantages over the previous methods and apparatuses for securing a boat 12 to a trailer 14. One advantage is the fact that a single person can align and secure the boat 12 onto the trailer 14 without the need of another person. The prior method of having an eyelet (not shown) attached on the bow which is secured to a clip extending from a line coiled about a winch causes significant issues for one person, including maintaining control of the boat 12 and having to enter into the water to secure the boat 12 to the eyelet (not shown). Additionally, when wind and waves apply forces to the boat 12, it is difficult to align the boat 12 on the trailer 14. If the boat 12 is misaligned on the trailer 14, the boat 12 may become damaged or may have to be realigned on the trailer 14 to be able to travel on the road. The present invention provides an apparatus that allows one person to align and secure the boat 12 onto the trailer 14 without having to get wet or leave the boat 12 when securing the boat with the winch 16.

While an exemplary embodiment discusses the use of winch system 10 with a boat and trailer, the system components taught herein may also be applied for the movement of other objects onto other support surfaces. In such a system, two guides are mounted onto the support surface rearward of the mounted winch and are spaced from each. First, second and third line sections are wound onto a reel with the first and second side line sections wound in a first rotational direction and a third middle line section for wound onto the reel in a second rotational direction opposite from the first rotational direction. All three lines are connected to each other at distal ends thereof.

Figure 4:
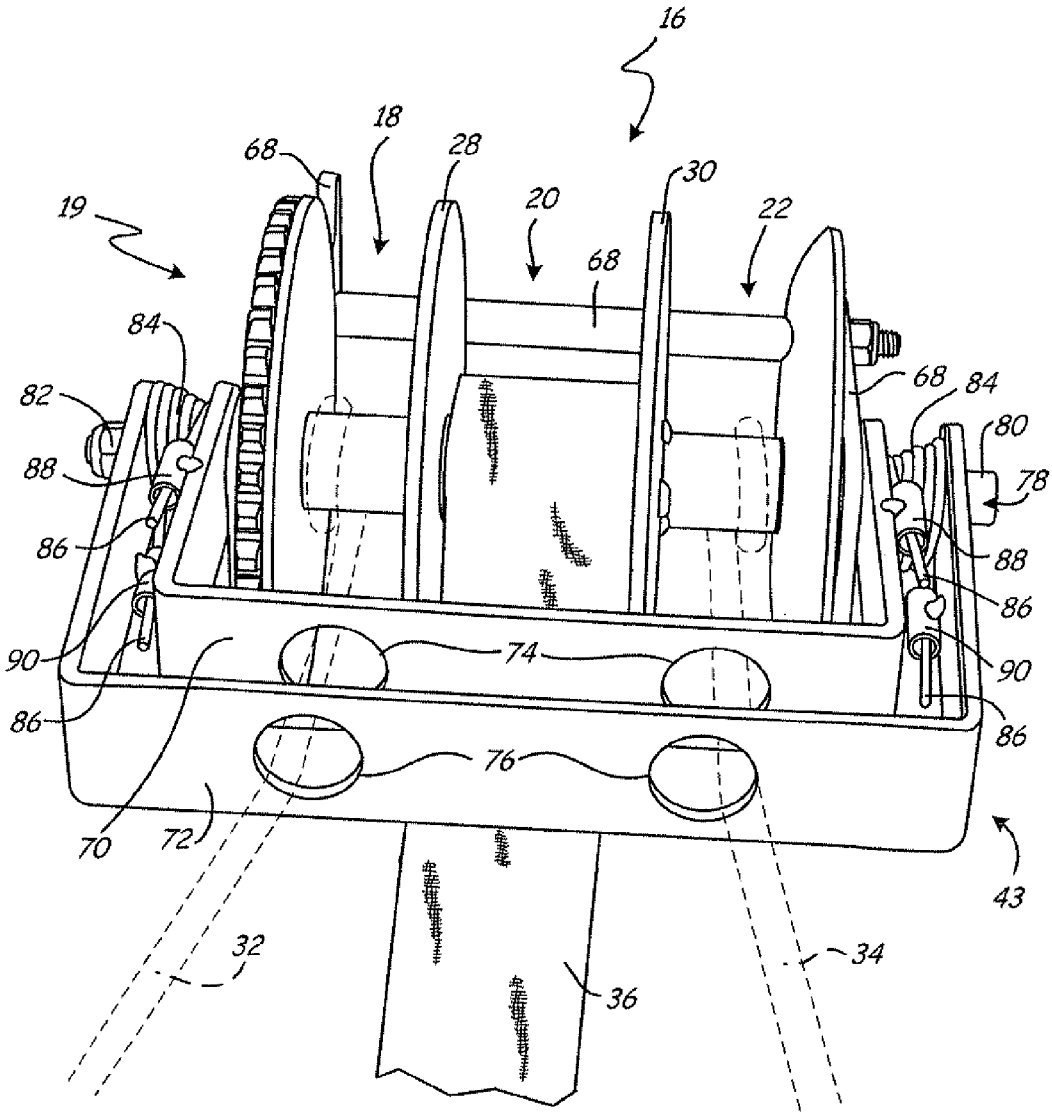
FIG. 4 is a perspective view of an exemplary rope tensioner in a first position, with the ropes pulled taut.

FIG. 4 is a perspective view of an exemplary rope tensioner 43 in a first position, with lines 32 and 34 pulled taut. In addition to the components of winch 16 described above, rope tensioner 43 further includes a mounting bracket 68 for mounting reel 19 and rope tensioner 43 onto a trailer 14 or other support surface, inner frame 70 and outer frame 72.

Inner frame 70 and outer frame 72 each contact lines 32, 34. In an exemplary embodiment, inner frame 70 includes apertures 74 and outer frame 72 includes apertures 76 through which lines 32 and 34 pass. In an exemplary embodiment, each aperture 74, 76 is a circular bore. While other aperture shapes may be used, a circular shape is chosen in an exemplary embodiment because of its symmetry and smooth edges, thereby facilitating the smooth movement of lines 32 and 34 therethrough while preventing snagging.

Inner frame 70 and outer frame 72 are movable with respect to each other to maintain tension in lines 32, 34. Mounting bracket 68, inner frame 70 and outer frame 72 are connected by axle 78 and secured thereon by stop 80 and nut 82. Both inner frame 70 and outer frame 72 are pivotable about axle 78. On each end of axle 78, spring coil 84 is disposed between inner frame 70 and outer frame 72. In an exemplary embodiment, each spring coil 84 is made of a coil of resilient wire, the ends 86 of which pass through sleeves 88 and 90. Inner frame 70 has sleeves 88 welded thereon. Outer frame 72 has sleeves 90 welded thereon. Thus, at each end of axle 78, a spring coil 84 is disposed so that one end 86 is retained by sleeve 88 onto inner frame 70 and the other end 86 is retained by sleeve 90 on outer frame 72.

Figure 5:
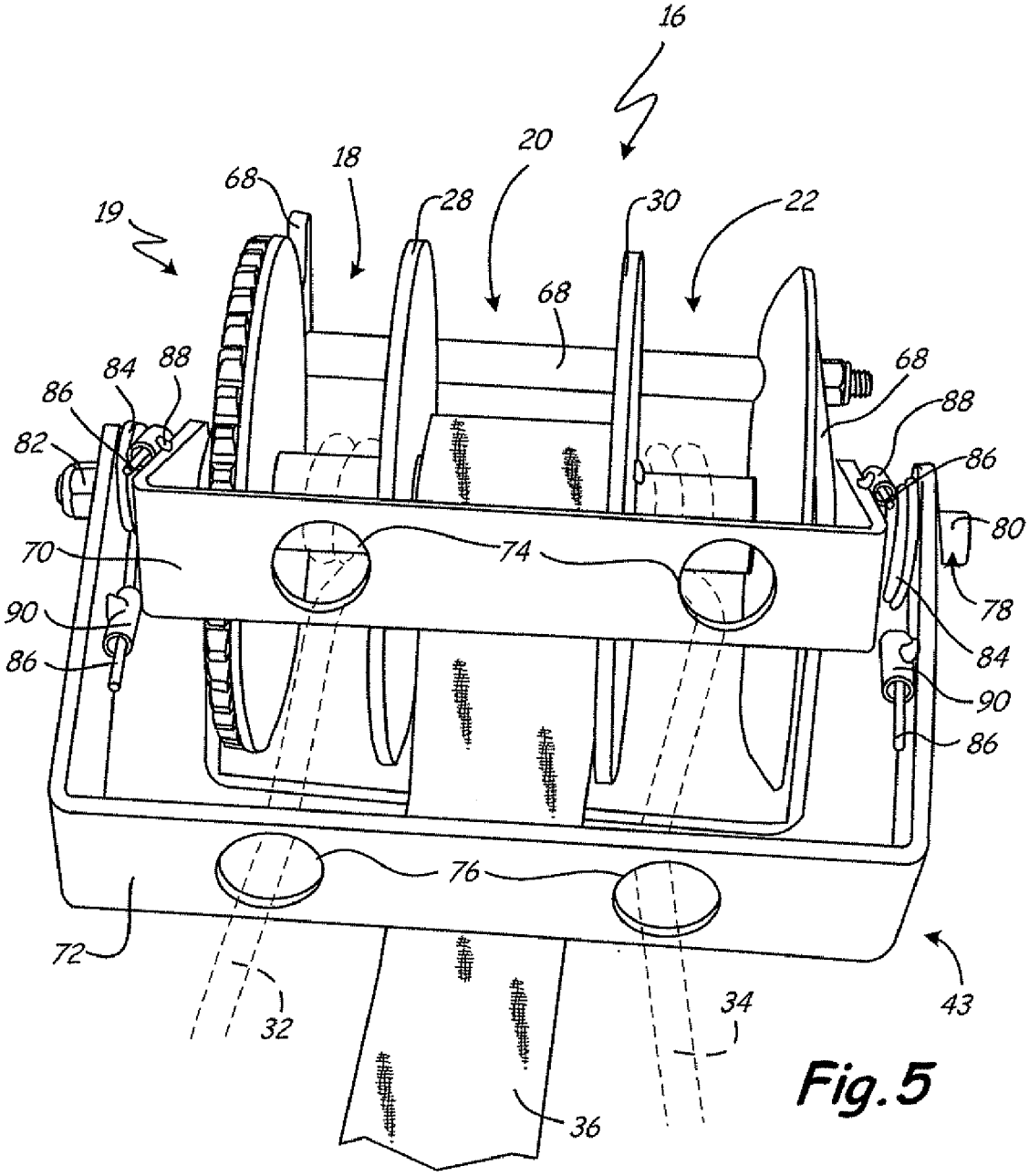
FIG. 5 is a perspective view of the rope tensioner in a second position, wherein the tensioner is taking up slack in the ropes.

In the configuration shown in FIG. 4, lines 32 and 34 are pulled taut so that apertures 74 of inner frame 70 and apertures 76 of outer frame 72 align in the direction of the tension of lines 32 and 34. As shown in FIG. 5, when tension on the lines 32, 34 is released, spring coils 84 bias inner frame 70 upward relative outer frame 72. Rope tensioner 43 thereby takes up slack in the lines 32, 34 by increasing the distance between apertures 74 of inner frame 70 and apertures 76 of outer frame 72. As rope tensioner 43 biases inner frame 70 away from outer frame 72, tension is maintained in lines 32, 34, thereby allowing boat 12 to remain in a desired position relative to winch 16 and guides 46, 48, without slipping.

Figure 6:
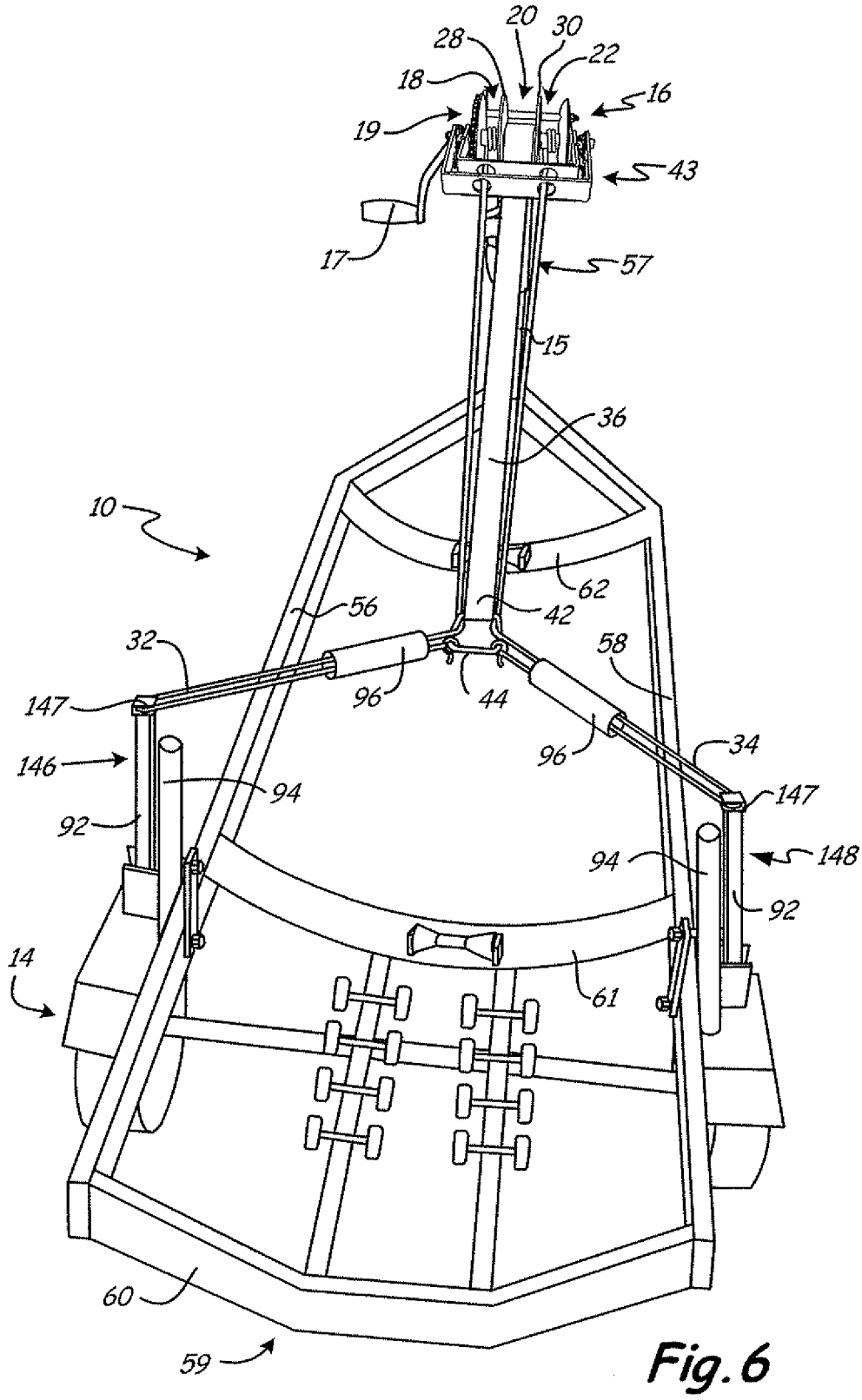
FIG. 6 is a perspective view of a boat trailer having a second embodiment of a winch system with a rope tensioner.

FIG. 6 is a perspective view of a boat trailer having a second embodiment of a winch system with a rope tensioner. In the illustrated embodiment, each guide 146, 148 includes an upright support 92 having pulley 147 thereon. Each guide 146, 148 preferably includes a roller or bumper 94 to prevent damage caused by contact between boat 12 and upright support 92. The illustrated embodiment also includes pipes 96 encasing left line 32 and right line 34. The presence of pipes 96 facilitates the sliding of boat 12 over lines 32 and 34 without damage thereto.

Figure 7:
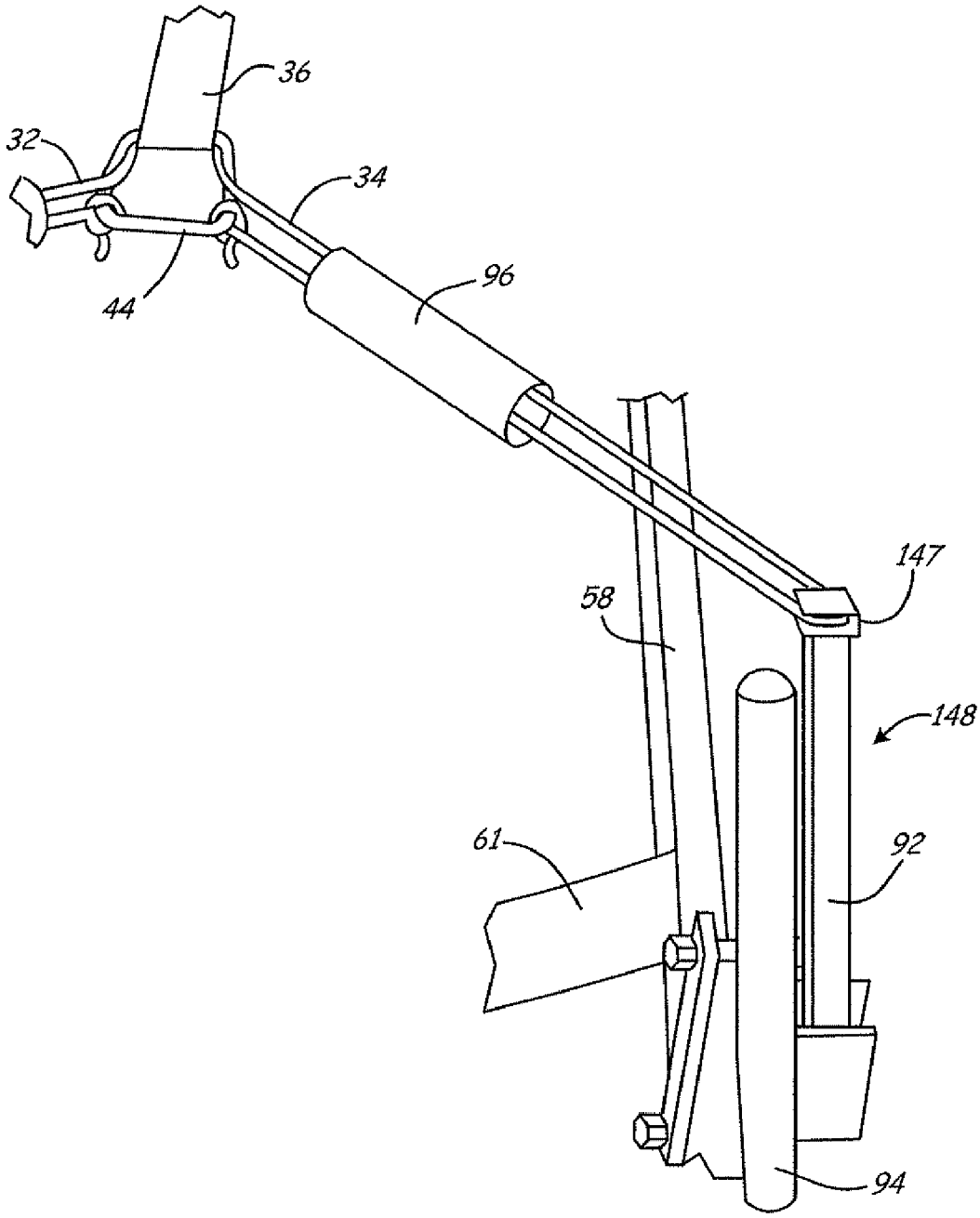
FIG. 7 is a partial perspective view of a guide of FIG. 6.
Figure 8:
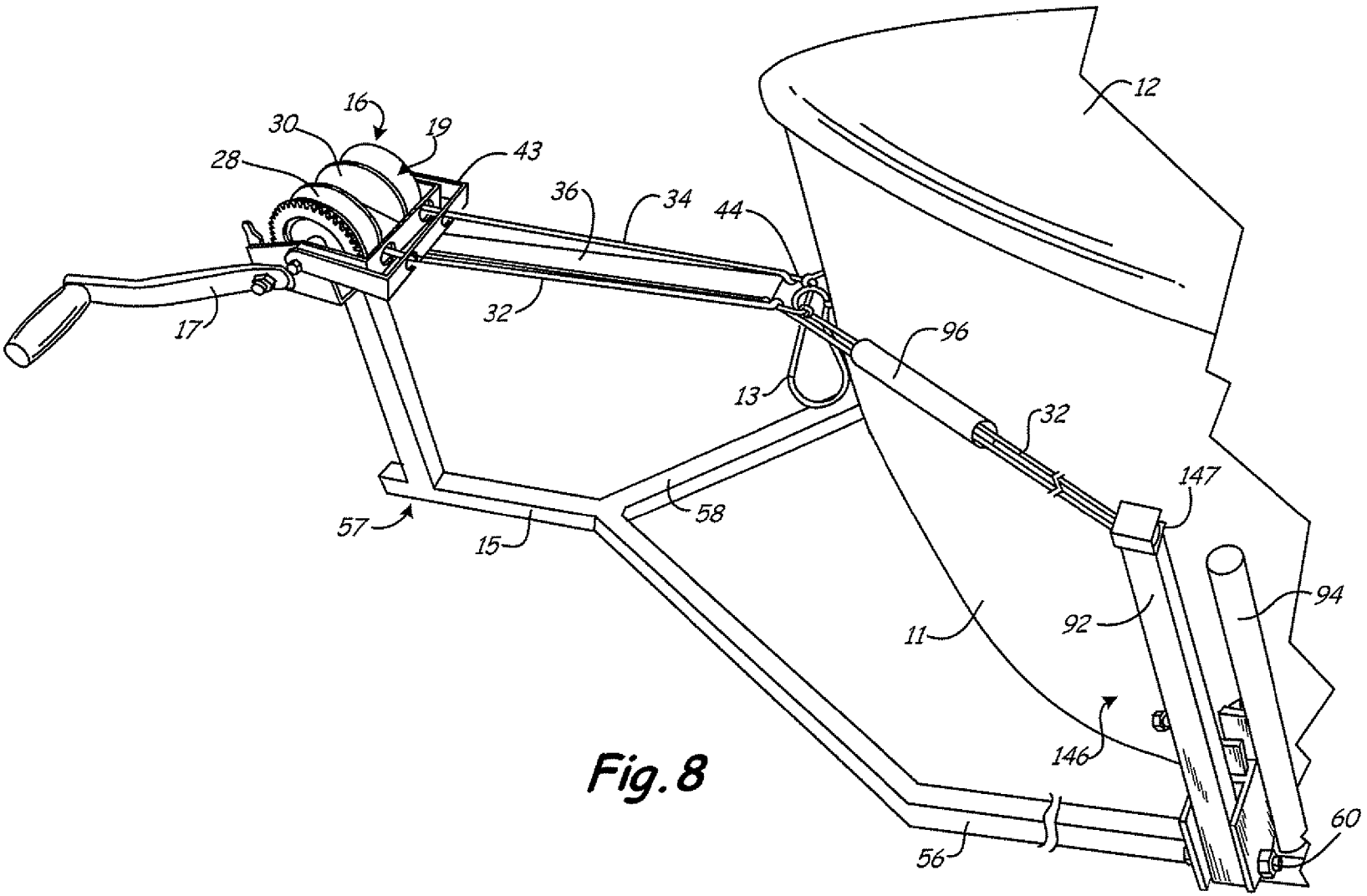
FIG. 8 is a partial perspective view of the winch system of FIG. 6 having a boat secured therewith and positioned proximate the winch.

FIG. 7 is a partial perspective view of right guide 148. It is to be understood that left guide 146 is analogous to right guide 148. In an exemplary embodiment, right line 34 slidably passes through loop 44, passes into pipe 96, wraps around pulley 147, passes again through pipe 96, and is secured to loop 44 at the end of right line 34. In an exemplary embodiment, loop 44 is configured as a D-ring. Passing each line 32, 34 through centered loop 44 assures that boat 12 is centered on trailer 14. In FIG. 8, bow 11 of boat 12 is attached by clip 13 to loop 44.

Although the present invention has been described with reference to preferred embodiments, workers skilled in the art will recognize that changes may be made in form and detail without departing from the spirit and scope of the invention.

What is claimed is:

1. An apparatus for positioning an object on a support surface, the support surface having a first guide and a second guide mounted thereon, the apparatus comprising:

a winch comprising a reel;

three lines wound about the reel, wherein the first line and the second line are wound about the reel in a first direction and the third line is wound about the reel in a second direction opposite the first direction, the first line extends around the first guide, the second line extends around the second guide, the third line extends between the first and second guides, and all three lines are connected to each other and to the object at their distal ends;

an inner frame contacting the first and second lines; and an outer frame contacting the first and second lines;

wherein the inner frame and the outer frame are movable with respect to each other to maintain tension in the first and second lines.

2. The apparatus of claim 1 further comprising:

a first aperture in the inner frame through which the first line passes;

a second aperture in the inner frame through which the second line passes;

a first aperture in the outer frame through which the first line passes; and a second aperture in the outer frame through which the second line passes.

3. The apparatus of claim 2 wherein each aperture is a circular bore.

4. The apparatus of claim 1 wherein the inner frame and the outer frame are pivotable with respect to each other.

5. The apparatus of claim 1 further comprising a spring coil disposed between the inner frame and the outer frame and connected to the inner frame and to the outer frame.

6. The apparatus of claim 1 wherein the first guide and the second guide are mounted on the support surface at a selected distance from the winch and spaced from each other.

7. An apparatus for positioning a boat having a clip attached to a bow onto a boat trailer, the boat trailer having a first guide and a second guide mounted thereon toward a rear of the boat trailer and being spaced from each other, the apparatus comprising:

a winch comprising a reel;

three lines wound about the reel, wherein the first line and the second line are wound about the reel in a first direction and the third line is wound about the reel in a second direction opposite the first direction, the first line extends around the first guide, the second line extends around the second guide, the third line extends between the first and second guides, and all three lines are connected to each other at their distal ends such that forward movement of the boat engages the clip with the lines such that the boat is secured to the lines so that it can be winched onto the trailer;

an inner frame contacting the first and second lines; and an outer frame contacting the first and second lines;

wherein the inner frame and the outer frame are separated from each other to maintain tension in the first and second lines.

8. The apparatus of claim 7 further comprising:

a first aperture in the inner frame through which the first line passes;

a second aperture in the inner frame through which the second line passes;

a first aperture in the outer frame through which the first line passes; and a second aperture in the outer frame through which the second line passes.

9. The apparatus of claim 8 wherein each aperture is a circular bore.

10. The apparatus of claim 7 wherein the inner frame and the outer frame are pivotable with respect to each other.

11. The apparatus of claim 7 further comprising a spring coil disposed between the inner frame and the outer frame and connected to the inner frame and to the outer frame.

12. The apparatus of claim 7 wherein the first and second guides each comprise a pulley.

* * * * *